United States Patent [19]

Bohlke

[11] 3,976,964

[45] Aug. 24, 1976

[54] SHORTING RING FOR AN AC SWITCHING MAGNET

[75] Inventor: Günther Bohlke, Amberg, Germany

[73] Assignee: Siemens Aktiengesellschaft, Munich, Germany

[22] Filed: May 22, 1973

[21] Appl. No.: 362,831

[30] Foreign Application Priority Data

May 31, 1972 Germany ..... 7220530[U]

[52] U.S. Cl. ..... 335/245; 335/244

[51] Int. Cl.[2] ..... H01F 7/10

[58] Field of Search ..... 335/243, 244, 245

[56] References Cited

UNITED STATES PATENTS 1,491,386 4/1924 Ford ..... 335/245

3,283,275 11/1966 Rider ..... 335/245

FOREIGN PATENTS OR APPLICATIONS 1,416,931 9/1965 France ..... 335/245

*Primary Examiner*—George Harris

*Attorney, Agent, or Firm*—Kenyon & Kenyon Reilly Carr & Chapin

[57] ABSTRACT

An improved arrangement for connecting a shorting ring to the pole of an AC switching magnet in which the connecting straps of the shorting ring are formed such that axis of the center of gravity of the shorting ring lies on a line coincident with the line between the connecting points thereby assuring that the joint receives as little stress as possible.

5 Claims, 3 Drawing Figures

SHORTING RING FOR AN AC SWITCHING MAGNET

BACKGROUND OF THE INVENTION

This invention relates to AC switching magnets in general and more particularly to an improved shorting ring for such magnets.

In AC switching magnets such as those used in air-brake contactors and the like, the magnetic pole is formed of a plurality of laminations which are generally riveted together. The end face of the pole contains a channel into which a shorting ring may be inserted. (For background as to the use of such shorting rings see U.S. Pat. No. 2,546,740). One conventional means of securing the shorting ring within the slot is that shown in German Offenlegungsschrift 1,764,522. As illustrated therein the shorting ring contains on each end a connecting strap which is bent down toward the magnet to hold the shorting ring in place after a brief elastic deformation during assembly. The straps at the end will contain indentations which will fit into either tabs bent out from the cover sheet of the pole piece or the rivets which hold the laminations together. With this sort of connection, particularly if the rivet is not centered, the shorting ring can move a small amount relative to the pole piece and will do so during each switching cycle of the magnet. This leads to wear of the mounting means i.e., the tabs or rivet end, and results in an undefined position of the shorting ring or the engagement point for the mounting. In addition some prior attachment arrangements, such as that shown in German Offenlegungsshrift 1,464,217, require attachment over a large area thereby increasing the torsion on the joint.

SUMMARY OF THE INVENTION

The present invention provides a new mounting arrangement which solves the problem of wear caused by the forces exerted on the magnet during switching. To accomplish this, the connecting straps of the shorting ring are made assymmetrical so that the center of gravity of the shorting ring will lie either on the line between the connecting points or be positioned behind the connecting points when viewed in the direction of the acceleration exerted on the switching magnet. By doing so, along with making as close to a point contact as is possible, the joint is practically free of torsional stresses. Through the assymmetrical shaping of the connecting straps it is possible to use an existing connecting element such as a rivet even if it is eccentrically located and still obtain good results. Connection points may also be formed using a spot welding on the rivet head of the switching magnets which is shaped to obtain a very sharp point attachment allowing the axis through the center of gravity to be hit very accurately. In this manner, no leverage will occur when the shorting ring is stressed by the operation of the AC switching magnet. In cases where the acceleration may not always be in the same direction, it is preferable that the axes through the center of gravity and the connecting line coincide.

DETAILED DESCRIPTION OF THE PREFERRED EMBODIMENT

Figure 1:
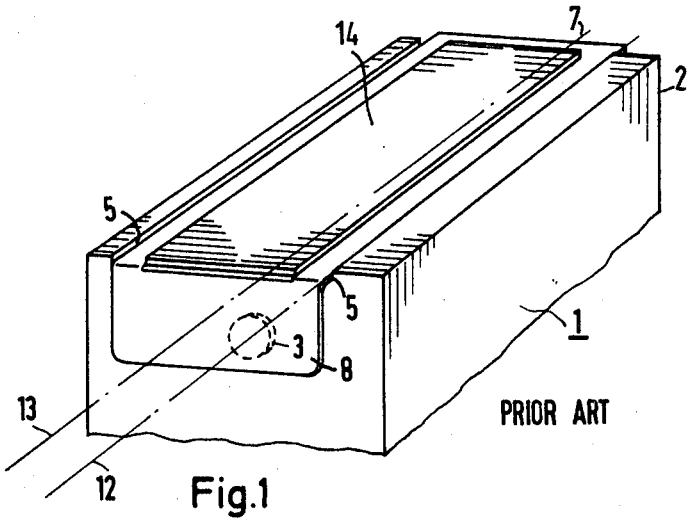
FIG. 1 is a perspective view illustrating the conventional manner of attaching shorting rings in the prior art.

FIG. 1 illustrates the conventional means of attachment used in prior art. Illustrated thereon is the end of a pole 1 made up of a plurality of laminations 2 which are held together with one or more rivets 3 passing through the stack of laminations. Each of the laminations has a slot cut in the vertical edges, which are indicated by the reference numeral 6 forming a channel in the end of the pole 1. Within this channel is placed a shorting ring 7 bent in a U shape so as to have a connecting strap 8 on each end. The connecting straps 8 slip over the ends of the rivets 3 and contain inserts into which the rivet 3 will slip to hold the shorting ring in place.

In all cases it is important that the attachment points be as close to a single sharp point as is possible, e.g. a small indentation which only contacts the top of a rounded rivet head. The line 12 is a line drawn between the connection points and the line 13 represents the axis of center of gravity of the shorting ring 7. With the rivet 3 off center, as is shown, when the switching magnet is subjected to accelerations in the direction 14, torsional stresses will be placed upon the connection between the strap 8 and the rivet 3 resulting in wear.

Figure 2:
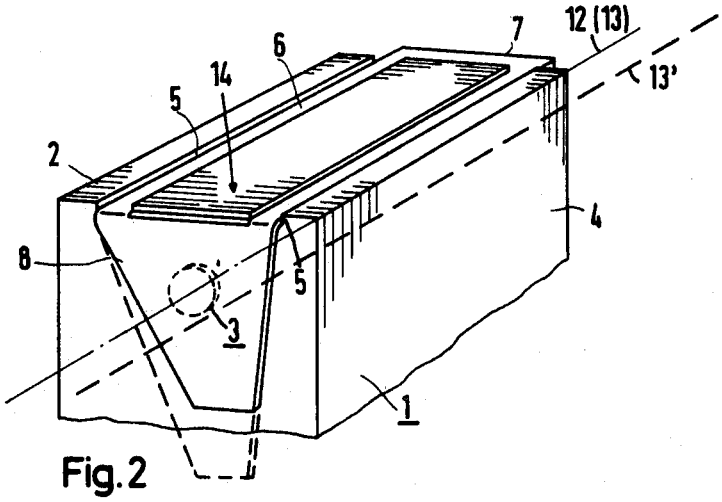
FIG. 2 is a perspective view of an AC magnet constructed according to the present invention and using the rivet heads of the pole piece for attaching the shorting ring.

A first embodiment for overcoming this problem is illustrated by FIG. 2 wherein similar parts are given identical reference numerals. Here the connecting strap 8 is made assymmetrical so that its center of gravity now falls on the line connecting the rivets 3 (which are the connection points). This embodiment is illustrated by the solid outline of the connecting strap 8 and by the dot-dash line labeled 12 and 13 indicating the coincidence of these two lines. Alternatively the strap may take the shape shown in dotted lines causing the center of gravity axis to be along the line 13' or behind the line 12 as viewed in the direction of acceleration 14. As noted above, the embodiment wherein the axes are coincident is preferable where the direction of acceleration 14 may vary. Thus care should be taken to assure accurate positioning. Otherwise, i.e., where the direction of acceleration 14 is always the same, the embodiment shown in dotted lines wherein the center of gravity axis is behind the connecting line may be used, i.e. in such a case the positioning can be less accurate as long as the center of gravity axis is behind the connecting line.

Figure 3:
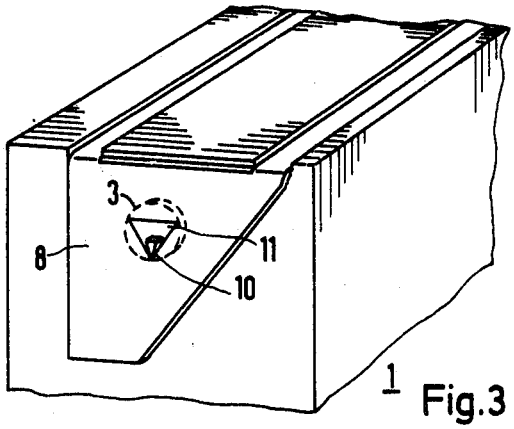
FIG. 3 is a perspective view of a second embodiment of the present invention wherein sharp knife connection points are formed.

An alternate embodiment is shown on FIG. 3. Here the head of rivet 3 has welded to it a small weld 10 which is then shaped to form a knife edge. The connecting strap 8 has a triangular hole cut in it to fit over the welded portion and to have its lower apex contact the knife edge of the weld thereby establishing an excellent point contact.

In determining the axis of the center of gravity, the weight of the long section 6 along with the connecting straps 8 of the shorting ring 7 should be considered. The center of gravity of the whole of the shorting ring 7 will, of course, fall within the U formed by the long portion 6 and the connecting straps 8. The axis 13 between the two ends should then intercept this point and be parallel to the edges of the long portion 6.

Thus an improved arrangement for mounting the shorting ring to the pole piece of a switching magnet has been shown. Although a specific embodiment has been illustrated and described it will be obvious to those skilled in the art that various modifications may be made without departing from the spirit of the invention which is intended to be limited solely by the appended claims.

What is claimed is:

1. In an AC switching magnet having a pole end face slotted to accept a shorting ring, said pole being made up of a plurality of laminations connected by at least one rivet, and having on each end of the pole, externally at the end of the rivet, an attachment point, said magnet, during switching being subject to an acceleration having an axis directed essentially perpendicular to the pole end face, an improved shorting ring comprising a shorting ring sized to fit in the pole slot with a connecting strap on each end adapted to fit over the ends of the pole and contact the attachment points thereon, said connecting straps being of an assymetrical shape so as to cause a longitudinal axis through the center of gravity of said shorting ring, when viewed along the axis of and in the direction of the acceleration to which the magnet is subjected to either coincide with or be behind the line connecting the attachment points.

2. The invention according to claim 1 said axis is behind said connecting line.

3. The invention according to claim 1 wherein said axis and said connecting line coincide.

4. The invention according to claim 1 wherein the heads of the rivet connecting the laminations are the attachment points.

5. The invention according to claim 1 wherein said attachment points comprise spot welds on the heads of the rivet connecting the laminations.

* * * * *